US006982623B2

(12) United States Patent
Satou et al.

(10) Patent No.: US 6,982,623 B2
(45) Date of Patent: Jan. 3, 2006

(54) STEP-UP TRANSFORMER FOR MAGNETRON DRIVING

(75) Inventors: Keiichi Satou, Daito (JP); Shinichi Sakai, Nara (JP); Kenji Yasui, Yamatokoriyama (JP); Haruo Suenaga, Katano (JP)

(73) Assignees: Matsushita Electric Industrial Co., Ltd., Osaka (JP); Nifco Inc., Kanagawa (JP)

( * ) Notice: Subject to any disclaimer, the term of this patent is extended or adjusted under 35 U.S.C. 154(b) by 75 days.

(21) Appl. No.: 10/663,146

(22) Filed: Sep. 16, 2003

(65) Prior Publication Data

US 2004/0108932 A1 Jun. 10, 2004

(30) Foreign Application Priority Data

Sep. 17, 2002 (JP) ..... P. 2002-270133

(51) Int. Cl.
*H01F 17/06* (2006.01)

(52) U.S. Cl. ..... 336/178; 336/212

(58) Field of Classification Search ..... 336/212, 336/208, 182, 180, 83
See application file for complete search history.

(56) References Cited

U.S. PATENT DOCUMENTS 6,297,593 B1 * 10/2001 Takashige et al. ..... 315/39.51
6,587,023 B2 * 7/2003 Miyazaki et al. ..... 336/83

FOREIGN PATENT DOCUMENTS

| | | | |
|---|---|---|---|
| CN | 1282081 | A | 1/2001 |
| DE | 35 29 011 | A1 | 2/1987 |
| EP | 1 058 279 | A1 | 12/2000 |
| JP | 2001-15259 | | 1/2001 |
| JP | 2001-189221 | | 7/2001 |
| JP | 2002-134266 | | 5/2002 |
| WO | WO 00/78100 | A1 | 12/2000 |

* cited by examiner

*Primary Examiner*—Anh Mai
(74) *Attorney, Agent, or Firm*—Pearne & Gordon LLP

(57) ABSTRACT

In a step-up transformer for magnetron driving in which two ferrite cores are opposed to each other with a gap G interposed therebetween, thereby forming a magnetic circuit including a middle core section, an outer core section and a coupling core section for coupling the middle core section and the outer core section, and a primary winding and a secondary winding are arranged to surround the middle core respectively, a sectional area of the middle core is increased, a number of winds in a radial direction of each of the primary winding and the secondary winding is increased and a number of winds in an axial direction is decreased, and the primary winding and the secondary winding are provided close to each other and a ratio of the sectional area of the middle core to that of the outer core is decreased to be 2:1 or less.

6 Claims, 7 Drawing Sheets

STEP-UP TRANSFORMER FOR MAGNETRON DRIVING

BACKGROUND OF THE INVENTION

The present invention relates to high-frequency dielectric heating using a magnetron such as a microwave oven, and more particularly to a step-up transformer for driving a magnetron by a switching power source.

FIG. 6 is a diagram showing the structure of a magnetron driving power source using a step-up transformer intended for the invention.

In FIG. 6, an alternating current sent from a commercial power source 11 is rectified into a direct current by a rectifying circuit 13, and the direct current is smoothened by a choke coil 14 and a filter capacitor 15 on the output side of the rectifying circuit 13 and is given to the input side of an inverter 16. The direct current is converted to have a desirable high frequency (20 kHz to 40 kHz) by turning ON/OFF a semiconductor switching unit in the inverter 16.

The inverter 16 includes a switching unit group having two power IGBTs 161 and 162 switching a direct current at a high speed and connected in series, for example, and an inverter control circuit 165 for driving the switching unit group.

A series connecting circuit for the power IGBT is connected between both positive and negative terminals of the direct current, and similarly, a series connecting circuit including two capacitors 163 and 164 is also connected between both positive and negative terminals of the direct current. Both ends of a primary winding 181 of a step-up transformer 18 are connected between a connecting point P1 of the power IGBTs and a connecting point P2 of the capacitors, respectively.

Furthermore, the gate of the power IGBT is driven by the inverter control circuit 165 and a current flowing to the primary side of the step-up transformer 18 is switched to ON/OFF at a high speed.

A signal input to the inverter control circuit 165 detects the primary side current of the rectifying circuit 13 by a CT 17, and the detected current is input to the inverter control circuit 165 and is used for controlling the inverter 16.

In the step-up transformer 18, a high-frequency voltage to be the output of the inverter 16 is applied to the primary winding 181 and a high voltage corresponding to a winding ratio is obtained from a secondary winding 182.

Moreover, a winding 183 having the small number of winds is provided on the secondary side of the step-up transformer 18 and is used for heating a filament 121 of a magnetron 12. The secondary winding 182 of the step-up transformer 18 includes a voltage doubler half-wave rectifying circuit 19 for rectifying an output thereof.

The voltage doubler half-wave rectifying circuit 19 is constituted by a high-voltage capacitor 191 and two high-voltage diodes 192 and 193, and the high-voltage capacitor 191 and the high-voltage diode 192 are conducted in a positive cycle (for example, the upper end of the secondary winding 182 is set to be positive in the drawing) and the left and right plates of the high-voltage capacitor 191 are charged to be positive and negative respectively in the drawing. Next, the high-voltage diode 193 is conducted in a negative cycle (the lower end of the secondary winding 182 is positive) and a double voltage obtained by adding the voltage of the high-voltage capacitor 191 charged in advance to that of the secondary winding 182 is applied between an anode 122 and the cathode 121 in the magnetron 12.

It is also possible to constitute a voltage doubler full-wave rectifying circuit by two high-voltage capacitors and two high-voltage diodes in place of the voltage doubler half-wave rectifying circuit 19. This is preferable in that the peak of an anode current flowing to the magnetron can be reduced and a durability can be enhanced in a high output.

While an example of the magnetron driving power source using the step-up transformer intended for the invention has been described above, the driving power source is not restricted thereto but any driving power source including a transformer for boosting a high frequency may be employed.

With the needs of a reduction in the size of a microwave oven, it is necessary to reduce the size of a step-up transformer. Therefore, a high frequency has been used as described above in place of a low frequency. For the core of the transformer, a metal core which is advantageous to a reduction in a size, a saturation and a cost (amorphous, a silicon steel plate) has been used at a low frequency. However, the metal core has not been used because of a great high-frequency loss at a high frequency. Instead, a ferrite core has been used.

There has been known a step-up transformer in which two ferrite cores are used to be butted each other in a gap, as shown in JP-A-2001-015259 (Japanese Patent Application Publication Number: 2001-015259), JP-A-2002-134266 (Japanese Patent Application Publication Number: 2002-134266) and JP-A-2001-189221 (Japanese Patent Application Publication Number: 2001-189221).

FIG. 7A and FIG. 7B show an example of a conventional well-known step-up transformer using a ferrite core, FIG. 7A being a longitudinal sectional view and FIG. 7B being a view seen in a direction of X—X of FIG. 7A. For easy understanding, a winding portion is omitted in FIG. 7B.

In FIG. 7A, 18' denotes a step-up transformer, 181' denotes a primary winding, 182' denotes a secondary winding, 183' denotes a heater winding and 184' denotes a coil bobbin.

18A' and 18B' denote U-shaped ferrite cores (circular sections), A1' denotes a core (a middle core) positioned in the winding in the core constituting the U-shaped ferrite core 18A', A3' denotes an outer core provided on the outside of the winding in the core constituting the U-shaped ferrite core 18A' and positioned in parallel with the middle core A1', and A2' denotes a coupling core for coupling the middle core A1' to the outer core A3'. Similarly, B1' denotes a core (a middle core) positioned in the winding of the core constituting the U-shaped ferrite core 18B', B3' denotes an outer core provided on the outside of the winding in the core constituting the U-shaped ferrite core 18B' and positioned in parallel with the middle core B', and B2' denotes a coupling core for coupling the middle core B1' to the outer core B3'.

The primary winding 181', the secondary winding 182' and the heater winding 183' are disposed in parallel on the same axis where the middle core A1' and the middle core B1' are opposed to each other. In case of a power source for driving a magnetron which often treats a large power, the use of a zero-volt switching method (hereinafter referred to as a ZVS method) based on a voltage resonance is a mainstream in order to relieve the load of a power semiconductor. In the ZVS method, it is necessary to set the coupling coefficient of the step-up transformer to be approximately 0.6 to 0.85 in order to obtain a resonance voltage, and a gap G' is provided.

The sectional area of the outer core A3' is almost equal to or slightly smaller than that of the middle core A1' (70% or less) as seen from FIG. 7B.

An installation area for attachment to a printed board is represented as L1'×L2' in case of such a conventional step-up transformer, wherein a full length (including a gap) in an axial direction of the middle core A1' and the middle core B1' is represented by L1' and a length from the outer end of the coil bobbin 184' to the outer core A3' (B3') in the U-shaped ferrite core 18A' is represented by L2'.

It is necessary to more increase a peak current flowing to the primary side of the step-up transformer when further raising the output of the magnetron. Consequently, the size of the step-up transformer is inevitably increased so that an installation area thereof is also increased.

SUMMARY OF THE INVENTION

In order to solve these problems, it is an object of the invention to provide a step-up transformer for magnetron driving which contributes to a reduction in the size of a power source and is not saturated at a high output, and furthermore, reduces an installation area thereof.

In order to attain the object, a first aspect of the invention is directed to a step-up transformer for magnetron driving in which two ferrite cores are opposed to each other with a gap interposed therebetween, thereby forming a magnetic circuit including a middle core section, an outer core section and a coupling core section for coupling the middle core section and the outer core section, and a primary winding and a secondary winding are arranged to surround the middle core respectively, wherein a sectional area of the middle core is increased, a number of winds in a radial direction of the primary winding to be wound around the middle core is increased and a number of winds in an axial direction is decreased, and a number of winds in a radial direction of the secondary winding is increased and a number of winds in an axial direction is decreased, and the primary winding and the secondary winding are provided close to each other via an insulator and a sectional area of the outer core is set to be smaller than that of the middle core.

Moreover, a second aspect of the invention is directed to a step-up transformer for magnetron driving in which two ferrite cores are opposed to each other with a gap interposed therebetween, thereby forming a magnetic circuit including a middle core section, an outer core section and a coupling core section for coupling the middle core section and the outer core section, and a primary winding and a secondary winding are arranged to surround the middle core respectively, wherein a sectional area of the middle core is increased, a number of winds in a radial direction of the primary winding to be wound around the middle core is increased and a number of winds in an axial direction is decreased, and a number of winds in a radial direction of the secondary winding is increased and a number of winds in an axial direction is decreased, and the primary winding and the secondary winding are provided close to each other via an insulator and a ratio of the sectional area of the middle core to that of the outer core is decreased to be 2:1 or less.

By the structures according to the first and second aspects of the invention, a dimension in the radial direction of the winding of the step-up transformer for magnetron driving is slightly increased and a length in the axial direction and the sectional area of the outer core section can be reduced. As a result, an installation area on a printed board can be considerably decreased.

Furthermore, a third aspect of the invention is directed to the step-up transformer for magnetron driving according to the first or second aspect of the invention, wherein the two ferrite cores include two U-shaped cores, or one U-shaped core and one I-shaped core.

By the structure, the shape of the step-up transformer for magnetron driving can be simplified, and furthermore, a magnetic circuit having a high efficiency can be formed.

Moreover, a fourth aspect of the invention is directed to the step-up transformer for magnetron driving according to the third aspect of the invention, wherein shapes of the two U-shaped cores are identical to each other.

By the structure, it is sufficient that only one kind of U-shaped core is manufactured. Consequently, a production cost can be considerably reduced.

A fifth aspect of the invention is directed to the step-up transformer for magnetron driving according to any of the first to fourth aspects of the invention, wherein each of sectional shapes of the middle core section and the outer core section is an oval including a circle or a polygon.

By the structure, the shape of the step-up transformer for magnetron driving can be simplified, and furthermore, a magnetic circuit having a high efficiency can be formed. In the case in which the middle core section has a circular shape, particularly, the winding speed of a coil can be increased, which is more effective.

Moreover, a sixth aspect of the invention is directed to the step-up transformer for magnetron driving according to the fifth aspect of the invention, wherein $h2<D1$, $h2<h1$, $D2<D1$ or $D2<h1$ is set, in which a height in the case in which the middle core section takes a sectional shape of a polygon is represented by h1 or a diameter in a direction of a height in the case in which the sectional shape is an oval including a circle is represented by D1, and a height in the case in which the outer core section takes a sectional shape of a polygon is represented by h2 or a diameter in a direction of a height in the case in which the sectional shape is an oval including a circle is represented by D2.

By the structure, a space is generated differently from the case of a conventional apparatus. Consequently, it is possible to provide a high-voltage capacitor and a high-voltage diode to be high-voltage power circuit components in the space.

Figure 1A:
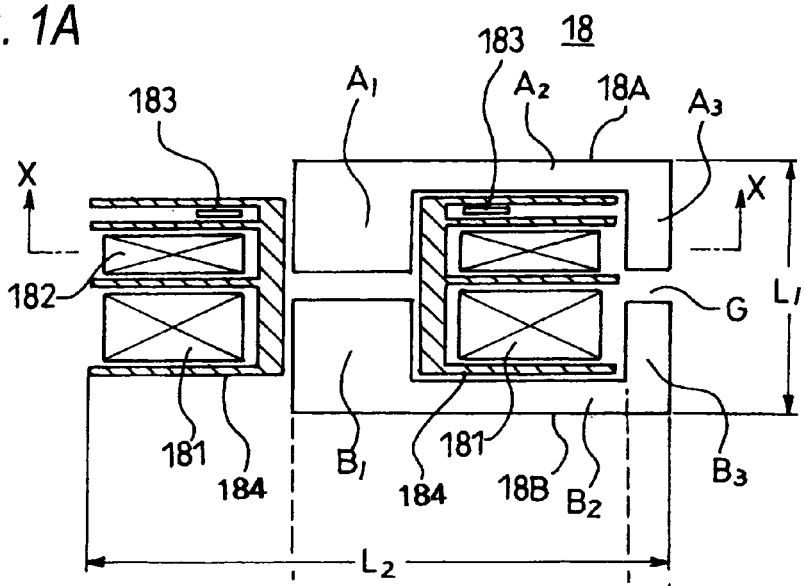
FIG. 1A and FIG. 1B are views showing a step-up transformer for magnetron driving according to a first embodiment of the invention, FIG. 1A being a longitudinal sectional view and FIG. 1B being a view seen in a direction of X—X in FIG. 1A, FIG. 2A and FIG. 2B are views showing a step-up transformer for magnetron driving according to a second embodiment of the invention, FIG. 2A being a longitudinal sectional view and FIG. 2B being a view seen in a direction of X—X in FIG. 2A, FIG. 3A and FIG. 3B are views showing a step-up transformer for magnetron driving according to a third embodiment of the invention, FIG. 3A being a longitudinal sectional view and FIG. 3B being a view seen in a direction of X—X in FIG. 3A, FIG. 4A and FIG. 4B are views showing a step-up transformer for magnetron driving according to a fourth embodiment of the invention, FIG. 4A being a longitudinal sectional view and FIG. 4B being a view seen in a direction of X—X in FIG. 4A.

Note that in the drawings, reference numerals 11 denotes a commercial power source, 12 a magnetron, 122 an anode, 121 a cathode, 13 a rectifying circuit, 14 a choke coil, 15 a filter capacitor, 16 an inverter, 161 and 162 a power IGBT, 163 and 164 a capacitor, 165 an inverter control circuit, 17 a CT, 18 a step-up transformer (U-U type), 181 a primary winding, 182 a secondary winding, 183 a winding for filament heating, 184 a coil bobbin, 18A and 18B a U-shaped ferrite core, A1 and B1 a middle core, A2 and B2 a coupling core, A3 and B3 an outer core, 19 a voltage doubler half-wave rectifying circuit, 191 a high-voltage capacitor, 192 and 193 a high-voltage diode, 28 an I-U type step-up transformer, 28A an I-shaped ferrite core, 28B a U-shaped ferrite core, G a gap.

DESCRIPTION OF THE PREFERRED EMBODIMENT

The invention will be described below in detail with reference to the drawings.

Figure 1B:
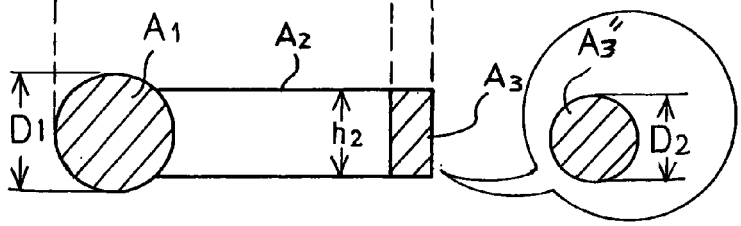

FIG. 1A and FIG. 1B show a step-up transformer for magnetron driving according to a first embodiment of the invention, FIG. 1A being a longitudinal sectional view and FIG. 1B being a view seen in a direction of X—X of FIG. 1A. For easy understanding, a winding portion is omitted in FIG. 1B.

In FIG. 1A, 18 denotes a step-up transformer, particularly, a U-U type step-up transformer using two U-shaped ferrite cores, 181 denotes a primary winding, 182 denotes a secondary winding, 183 denotes a heater winding and 184 denotes a coil bobbin. 18A and 18B denote U-shaped ferrite cores (middle cores having circular sections), A1 denotes a core (a middle core) positioned in the winding of the core constituting the U-shaped ferrite core 18A, A3 denotes an outer core provided on the outside of the winding in the core constituting the U-shaped ferrite core 18A and positioned in parallel with the middle core A1, and A2 denotes a coupling core for coupling the middle core A1 to the outer core A3. Similarly, B1 denotes a core (a middle core) positioned in the winding of the core constituting the U-shaped ferrite core 18B, B3 denotes an outer core provided on the outside of the winding in the core constituting the U-shaped ferrite core 18B and positioned in parallel with the middle core B1, and B2 denotes a coupling core for coupling the middle core B1 to the outer core B3.

In the ferrite core step-up transformer 18, the two U-shaped ferrite cores 18A and 18B taking the same shapes are opposed to each other with a gap (an air gap) G provided, and a magnetic closed circuit of the gap G—the middle core section A1—the coupling core section A2—the outer core section A3—the gap G—the outer core section B3—the coupling core section B2—the middle core section B1 is formed with the gap G interposed.

Since it is necessary to set the coupling coefficient of the step-up transformer to be approximately 0.6 to 0.85, the gap G is set correspondingly.

In the middle cores A1 and B1 which are connected in series, the primary, secondary and tertiary windings 181, 182 and 183 taking circular shapes are arranged in an axial direction to surround them, respectively. Moreover, the coil bobbin 184 to be an insulator is provided between each winding and the middle core. It is more preferable that the insulator should be provided double for safety.

Figure 7A:
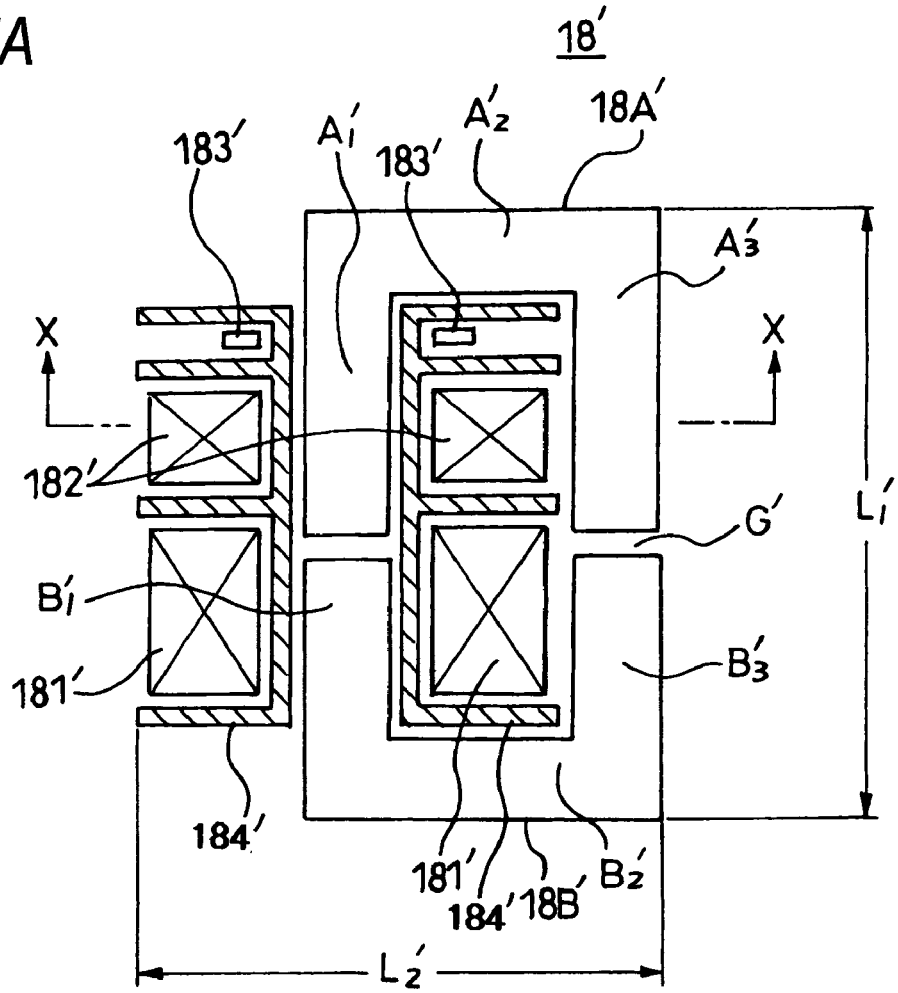
FIG. 7A and FIG. 7B are views showing an example of a conventional well-known step-up transformer using a ferrite core, FIG. 7A being a longitudinal sectional view and FIG. 7B being a view seen in a direction of X—X in FIG. 7A.
Figure 7B:
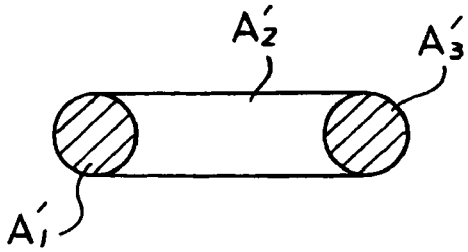

The sectional areas of the middle cores A1 and B1 (in a perpendicular direction to an axis, A1 in FIG. 7B) are more increased as is apparent from a comparison with those in FIG. 7A and FIG. 7B (A1' in FIG. 7B). On the other hand, the sectional areas of the outer cores A3 and B3 (in a perpendicular direction to an axis, A3 in FIG. 7B) are more reduced as compared with those in FIG. 7A and FIG.7B (A3' in FIG. 7B).

The grounds for the foregoing are as follows. The number of winds in the radial direction of each of the windings 181 and 182 to be wound around the middle cores A1 and B1 is increased and an interval in an axial direction between the primary winding 181 and the secondary winding 182 is reduced as greatly as possible (in such a manner that a space for providing an insulator is formed). Consequently, mutual inductances are increased and the sectional areas of the middle cores A1 and B1 are increased. Thus, a closed magnetic path is directly formed without partially passing through the outer core. It is possible to decrease the sectional areas of the outer cores A3 and B3 corresponding to a magnetic flux which does not pass through the outer core.

The values of the mutual inductances of the primary winding 181 and the secondary winding 182 in the invention are measured as 0.32, while conventional values are 0.17. It is apparent that the values are almost a double of the conventional values.

Correspondingly, a magnetic flux to be coupled directly through a winding is increased. Consequently, the sectional area of the outer core can be reduced so that the transformer can be small-sized.

As a result of the experiment, the sectional areas of the middle core section and the outer core section are obtained as follows for the conventional ferrite core step-up transformer 18' and the ferrite core step-up transformer 18 according to the invention having the same output as that of the conventional ferrite core step-up transformer 18'.

Table 1: Each of the Sectional Areas of the Middle Core Sections and the Outer Core Sections in the Conventional Example and the Invention 1) The conventional ferrite core step-up transformer 18'
   (1) middle core section A1'=254 mm2
   (2) outer core section A3'=180 mm2
   (3) outer/middle ratio=0.7
2) The ferrite core step-up transformer 18 according to the invention
   (1) middle core section A1=415 mm2
   (2) outer core section A3=105 mm2
   (3) outer/middle ratio=0.25
   (4) middle core ratio in the invention/conventional example=1.63
   (5) outer core ratio in the invention/conventional example=0.58

As described above, the sectional area in the perpendicular direction to the axis of each of the middle cores A1 and B1 (for example, A1 in FIG. 1B)) is increased to be 1.63 times as large as the sectional area in the conventional example (for example, A1' in FIG. 7B). On the other hand, the sectional area in the perpendicular direction to the axis of each of the outer cores A3 and B3 (for example, A3 in FIG. 1B) is reduced to be 0.58 time as large as the sectional area in the conventional example (for example, A3' in FIG. 7B).

Moreover, an installation area for attachment to a printed board is represented as L1×L2 in case of the step-up transformer according to the invention, wherein a full length in an axial direction of the middle cores A1 and B1 in the U-shaped ferrite core 18 is represented by L1 and a length from the outer end of the coil bobbin 184 to the outer core A3 (B3) is represented by L2.

As a result of the experiment, an installation area (L1'×L2') of the conventional ferrite core step-up transformer 18' and an installation area (L1×L2) of the ferrite core step-up transformer 18 according to the invention having the same output as that of the conventional ferrite core step-up transformer 18' are obtained as follows.

Table 2: L1 and L2 in the Conventional Example and the Invention

1) The ferrite core step-up transformer 18' in the conventional example
   (1) L1'=65 mm
   (2) L2'=65 mm
   (3) installation area (L1'×L2')=4225 mm2
2) The ferrite core step-up transformer 18 in the invention
   (1) L1=40 mm
   (2) L2=65 mm
   (3) installation area (L1×L2)=2600 mm2
   (4) installation area ratio of the invention/conventional example=0.62

As described above, in the flat coil according to the invention, the number of winds in the radial direction of the winding to be wound around the middle core is increased. To the contrary, the number of winds in the axial direction is decreased, and the primary winding and the secondary winding are provided close to each other, thereby reducing the sectional area of the outer core. Consequently, the installation area ratio in the invention/conventional example=0.62 is obtained.

Since an amorphous material which is expensive is not used for the core of the transformer, moreover, a cost can be reduced.

As described above, the transformer according to the invention features that the winding is flattened by shortening a distance between the primary winding and the secondary winding. Consequently, a mutual induction between a primary coil and a secondary coil is increased so that the outside core can be thinned correspondingly.

Some coils in the conventional art are simply flattened. For example, as described in the JP-A-2002-134266, the outer core is not provided, and a gap is enlarged, resulting in a very poor efficiency of the transformer. In the invention, however, the coil is flat and has the middle core, the outer core and the coupling core. Therefore, the efficiency of the transformer can be enhanced more greatly than that in the ferrite core step-up transformer disclosed in JP-A-2002-134266.

While the core of the transformer is of such a type that two U shapes are combined, and the middle core has a circular sectional shape and the outer core has a rectangular sectional shape in the first embodiment described above, the outer core may take a circular shape A3" to be surrounded in a circle of in FIG. 1B. The rectangular shape and the circular shape are not restricted, which will be described below.

Figure 3A:
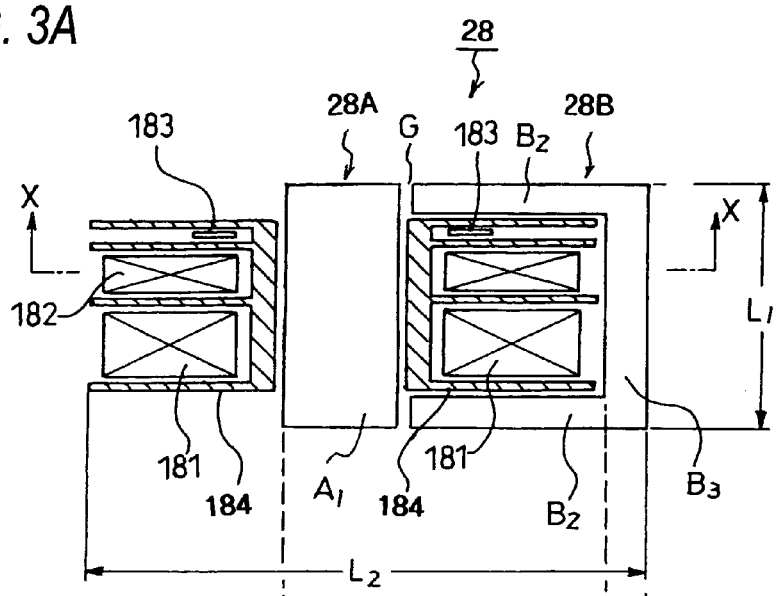
Figure 3B:
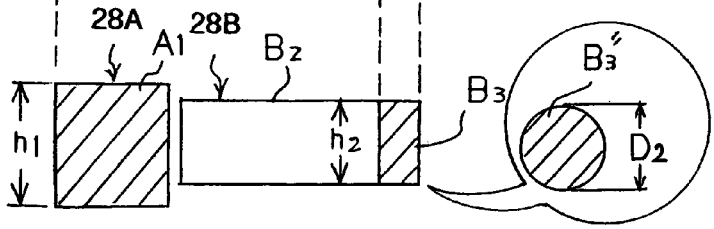
Figure 4A:
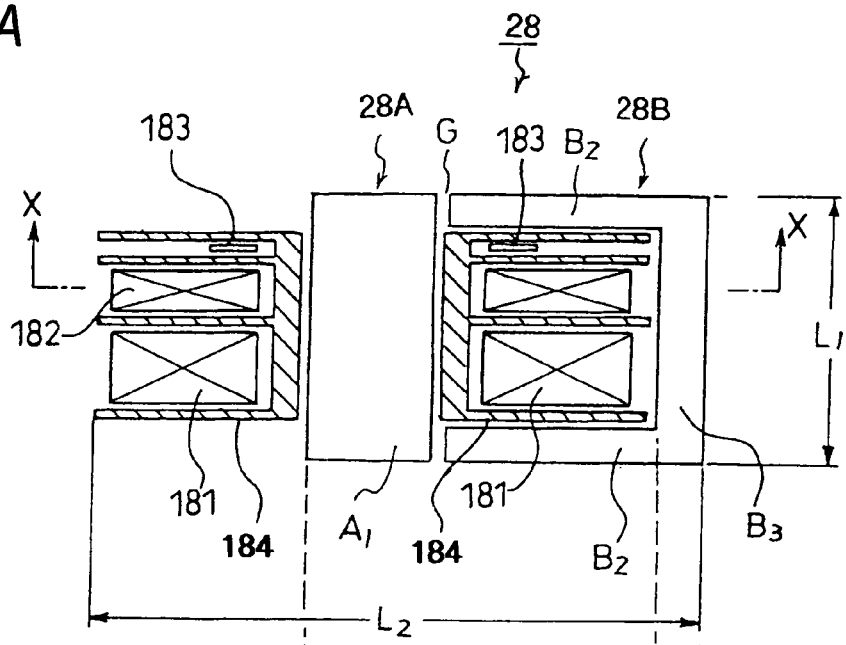
Figure 4B:
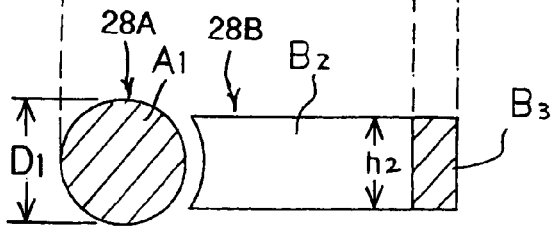

Moreover, the invention is not restricted to the first embodiment but can also be applied to (2) a type in which two U-shaped cores are combined and a middle core has a rectangular sectional shape (a second embodiment, FIG. 2A and FIG. 2B), (3) a type in which one U-shaped core and one I-shaped core are combined and a middle core has a rectangular sectional shape (a third embodiment, FIG. 3A and FIG. 3B), and (4) a type in which one U-shaped core and one I-shaped core are combined and a middle core has a circular sectional shape (a fourth embodiment, FIG. 4A and FIG. 4B).

Figure 2A:
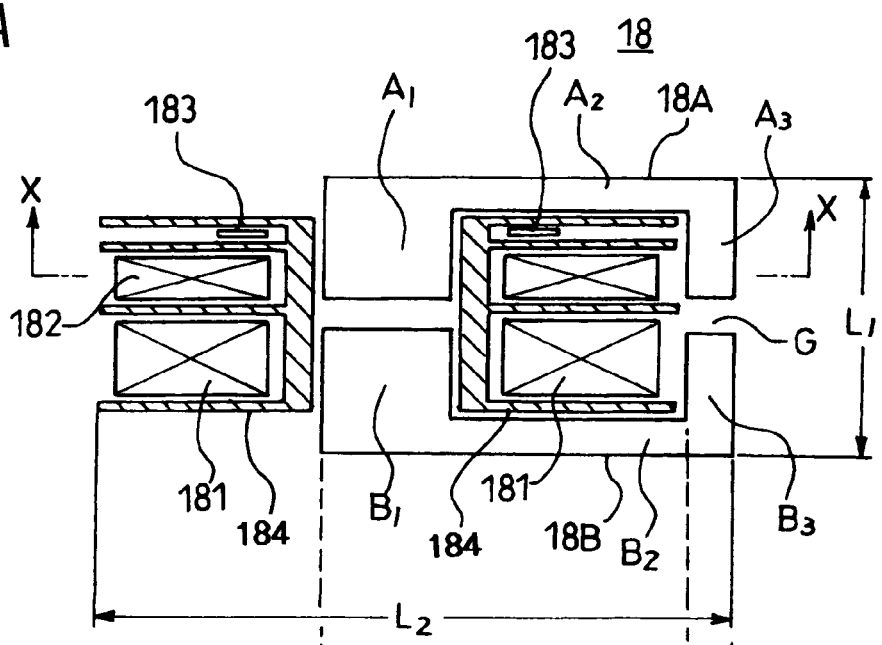
Figure 2B:
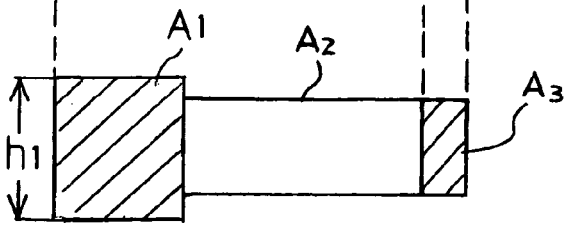

FIG. 2A and FIG. 2B show a step-up transformer according to a second embodiment of the invention, FIG. 2A being a longitudinal sectional view and FIG. 2B being a view seen in a direction of X—X in FIG. 2A. For easy understanding, a winding portion is omitted in FIG. 2B.

In FIG. 2A and FIG. 2B, the same reference numerals as those in FIG. 1A and FIG. 1B represent the same portions and description thereof will be therefore omitted. FIG. 2A and FIG. 2B are different from FIG. 1A and FIG. 1B in that middle cores A1 and B1 have rectangular sectional shapes. Since they have the rectangular sections, a space can be utilized effectively.

U-shaped ferrite cores 18A and 18B have the same shapes and are opposed to each other with a gap G provided, thereby forming a magnetic closed circuit of the gap G—the middle core section A1—a coupling core section A2—an outer core section A3—the gap G—an outer core section B3—a coupling core section B2—the middle core section B1 with the gap G interposed.

As described in the first embodiment, the number of winds in the radial direction of each of windings 181 and 182 to be wound around the middle cores A1 and B1 is increased and an interval in an axial direction between the primary winding 181 and the secondary winding 182 is reduced as greatly as possible (in such a manner that a space for providing an insulator is formed). Consequently, mutual inductances are increased.

Similarly, the sectional areas of the middle cores A1 and B1 are larger than those in FIG. 7A and FIG. 7B, while the sectional areas of the outer cores A3 and B3 are smaller than those in FIG. 7A and FIG. 7B.

Accordingly, the mutual inductances are great and the sectional areas of the middle cores A1 and B1 are large, and furthermore, a closed magnetic path is directly formed without partially passing through the outer core. Consequently, it is possible to decrease the sectional areas of the outer cores A3 and B3 corresponding to a magnetic flux which does not pass through the outer core. Thus, the transformer can be small-sized.

In JP-A-2001-189221, a transformer uses two U-shaped cores.

A gap is provided in the central part of a primary winding and heat is greatly generated in the gap. In order to eliminate a bad influence on the primary winding, therefore, the gap is provided between the primary winding and the secondary winding to improve heat radiation, thereby enhancing a cooling characteristic.

However, JP-A-2001-189221 has not described that the two U-shaped cores have the same shapes and a flat coil is used.

In the invention, one kind of U-shaped core is used symmetrically so that a productivity can be enhanced, and the flat coil is used so that a size can be reduced and an installation area on a printed board can be greatly decreased.

While the core of the transformer is of such a type that two U shapes are combined, and the middle core has a rectangular sectional shape and the outer core has a rectangular sectional shape in the second embodiment described above, the outer core takes a circular shape A3" to be surrounded in a circle of FIG. 1B. Moreover, the rectangular shape and the circular shape are not restricted, which will be described below.

FIG. 3A and FIG. 3B show a step-up transformer according to a third embodiment of the invention, FIG. 3A being a longitudinal sectional view and FIG. 3B being a view seen in a direction of X—X in FIG. 3A. For easy understanding, a winding portion is omitted in FIG. 3B.

In FIG. 3A and FIG. 3B, 28 denotes a ferrite core step-up transformer according to the third embodiment of the invention and comprises an I-shaped ferrite core 28A (a rectangular section) and a U-shaped ferrite core 28B (a rectangular section). Moreover, 181 denotes a primary winding, 182 denotes a secondary winding, 183 denotes a heater winding and 184 denotes a coil bobbin.

A1 denotes a middle core including the I-shaped ferrite core 28A, B2 (in two portions) and B3 denote a core constituting the U-shaped ferrite core 28B, B2 denotes a coupling core, and B3 denotes an outer core for connecting the two coupling cores B2.

The ferrite core step-up transformer 28 has the U-shaped ferrite core 28B opposed to the I-shaped ferrite core 28A provided in a winding with a gap (an air gap) G provided, thereby forming a magnetic closed circuit of the gap G—the coupling core section B2—the outer core section B3—the coupling core section B2—the gap G—the middle core section A1.

The sectional area of the middle core A1 is larger than that of the middle core in FIG. 7A and FIG. 7B. On the other hand, the coupling core B2 and the outer core B3 are smaller than the outer core in FIG. 7A and FIG. 7B.

As described in the first embodiment, moreover, the number of winds in the radial direction of each of the windings 181 and 182 to be wound around the middle cores A1 and B1 is increased and an interval in an axial direction between the primary winding 181 and the secondary winding 182 is reduced as greatly as possible (in such a manner that a space for providing an insulator is formed). Consequently, mutual inductances are increased.

Accordingly, the mutual inductances are great and the sectional area of the middle core A1 is large, and furthermore, a closed magnetic path is directly formed without partially passing through the outer core. Consequently, it is possible to decrease the sectional areas of the coupling core B2 and the outer core B3 corresponding to a magnetic flux which does not pass through the outer core. Thus, the transformer can be small-sized.

The core is formed of ferrite. In the case in which the sectional area of the core is decreased, therefore, the ferrite is easily broken due to burning and a yield is deteriorated if a width in the direction of a thickness is excessively reduced. For this reason, it is preferable to reduce a width in the direction of a height without decreasing the width in the direction of the thickness.

While the core of the transformer is of such a type that an I shape and a U shape are combined, and the middle core has a rectangular sectional shape and the outer core has a rectangular sectional shape in the third embodiment described above, the outer core may take a circular shape B3" to be surrounded in a circle of the FIG. 3B. The rectangular shape and the circular shape are not restricted, which will be described below.

FIG. 4A and FIG. 4B show a step-up transformer according to a fourth embodiment of the invention, FIG. 4A being a longitudinal sectional view and FIG. 4B being a view seen in a direction of X—X in FIG. 4A. For easy understanding, a winding portion is omitted in FIG. 4B.

In FIG. 4A and FIG. 4B, the same reference numerals as those in FIG. 3A and FIG. 3B represent the same portions and description thereof will be therefore omitted. FIG. 4A and FIG. 4B are different from FIG. 3A and FIG. 3B in that a middle core A1 has a circular sectional shape. Since the section takes the circular shape, a winding speed can be increased so that a productivity can be enhanced.

Moreover, the sectional area of the middle core A1 is larger than that of the middle core in FIG. 7A and FIG. 7B. On the other hand, a coupling core B2 and an outer core B3 are smaller than the outer core in FIG. 7A and FIG. 7B.

As described in the first embodiment, furthermore, the number of winds in the radial direction of each of windings 181 and 182 to be wound around the middle cores A1 and B1 is increased and an interval in an axial direction between the primary winding 181 and the secondary winding 182 is reduced as greatly as possible (in such a manner that a space for providing an insulator is formed). Consequently, mutual inductances are increased.

Accordingly, the mutual inductances are great and the sectional area of the middle core A1 is large, and furthermore, a closed magnetic path is directly formed without partially passing through the outer core. Consequently, it is possible to decrease the sectional areas of the coupling core B2 and the outer core B3 corresponding to a magnetic flux which does not pass through the outer core. Thus, the transformer can be small-sized.

While the core of the transformer is of such a type that an I shape and a U shape are combined, and the middle core has a circular sectional shape and the outer core has a rectangular sectional shape in the fourth embodiment described above, the outer core takes a circular shape B3" to be surrounded in a circle of FIG. 3B. The rectangular shape and the circular shape are not restricted, which will be described below.

It may be common among FIG. 1A to FIG. 4B, the coupling core A2 reaching the outer core A3 from the middle core A1 is formed in vertically parallel in FIG. 1B, however may be tapered from the middle core A1 having a large diameter to the outer core A3. In any case, according to the present invention, a space is generated in the upper and lower parts of the outer core and the upper and lower parts of a portion reaching the outer core differently from the conventional example.

While the ferrite core taking a rectangular sectional shape has been described in each of the embodiments, it is a matter of course that the invention is not restricted to the rectangular shape but may be applied to polygons such as a pentagon, a hexagon, an octagon, a decagon and a dodecagon, more strictly, polygons which are chamfered or rounded. Moreover, the sectional shape is not restricted to a circle but may be an oval.

FIG. 5 is a view for specifically explaining the sectional shapes, implying that the sectional shape A1 of the middle core or the sectional shape A3 of the outer core which has been described above can take any of shapes "a" to "f" in FIG. 5.

Figure 5:
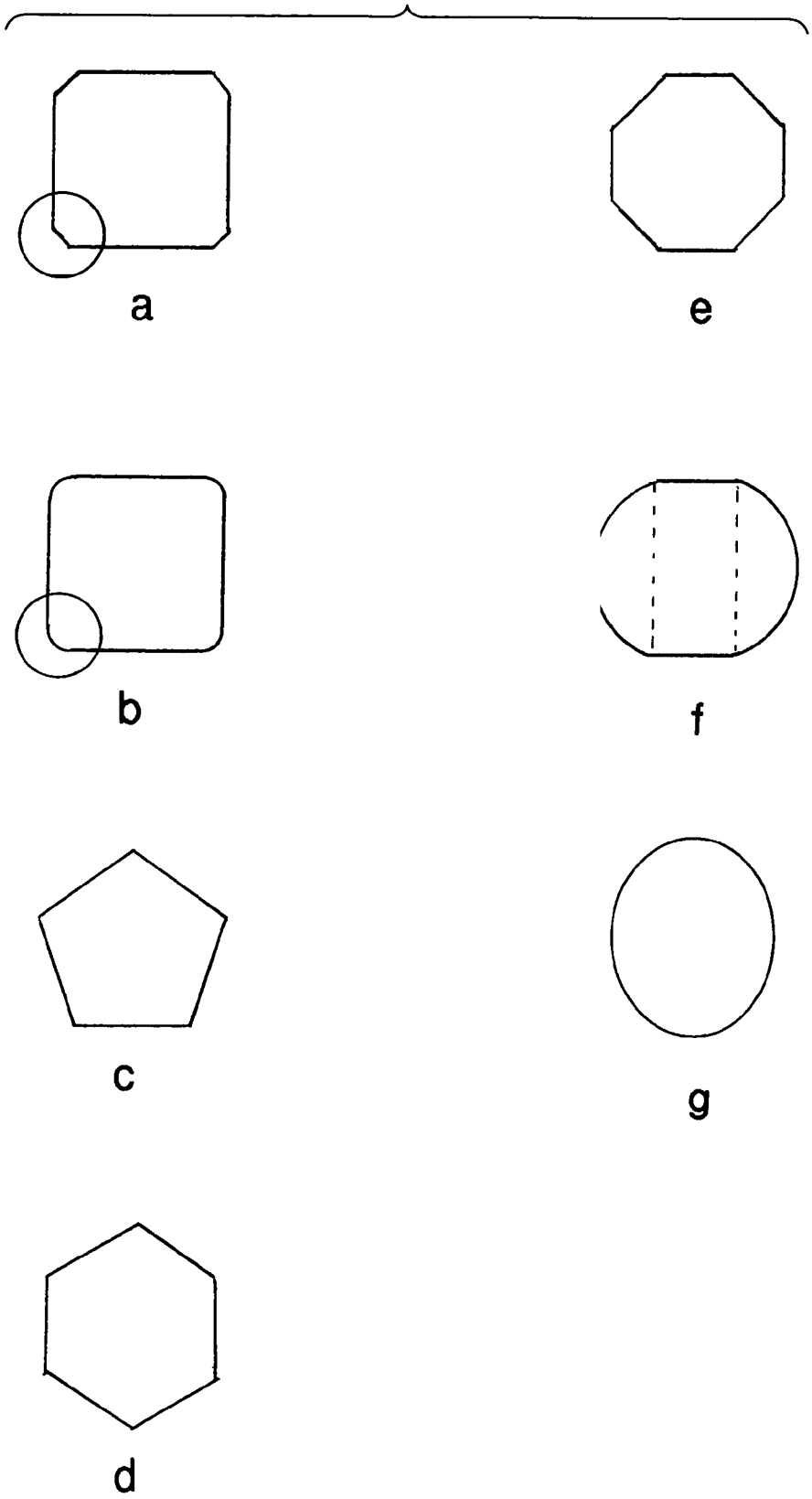
FIG. 5 is a view for explaining various sectional shapes of a ferrite core.
Figure 6:
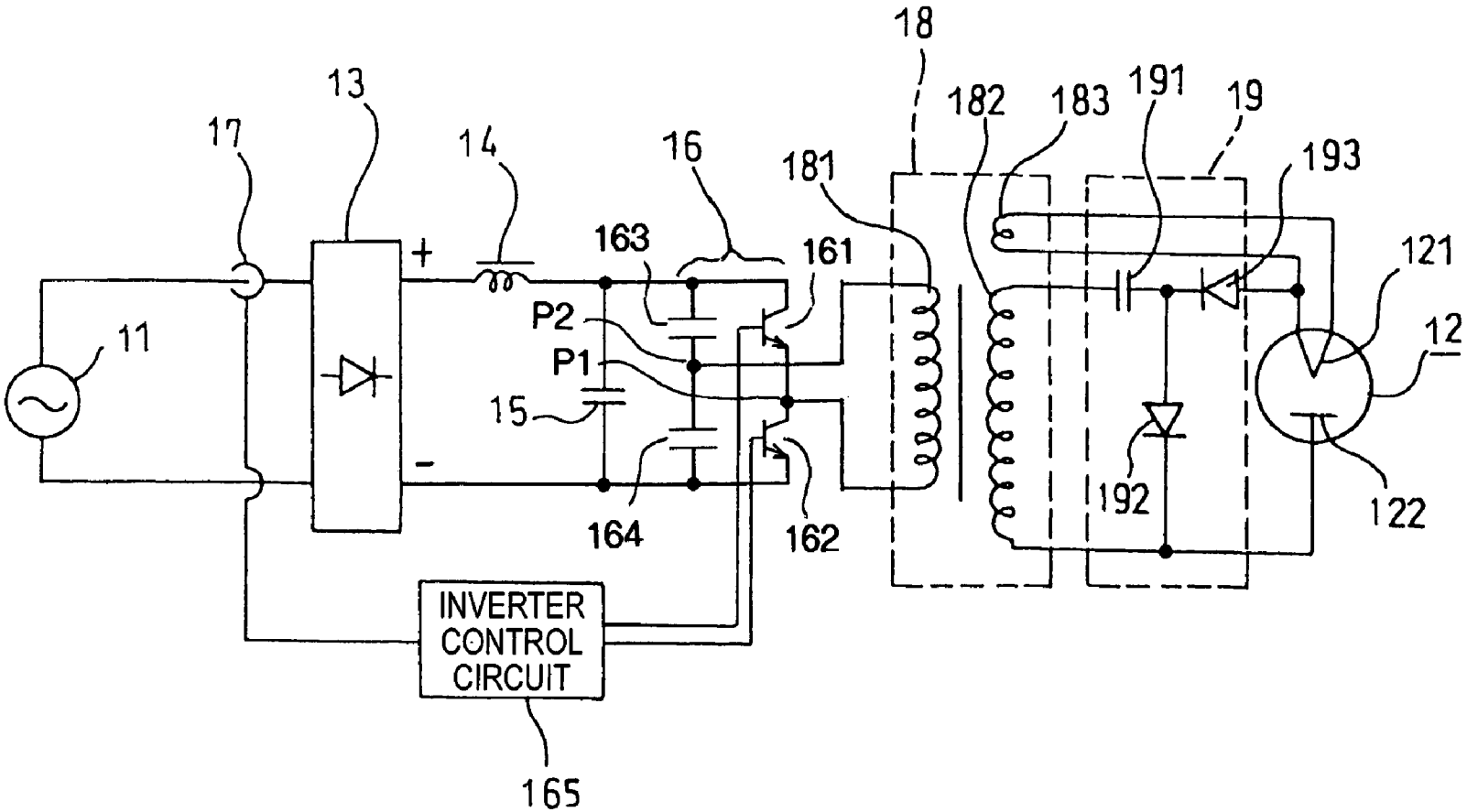
FIG. 6 is a diagram showing the structure of a magnetron driving power source using the step-up transformer intended for the invention.

In FIG. 5, "a" indicates a chamfered rectangle (a portion surrounded by a circle). "b" indicates a rounded rectangle (a portion surrounded by a circle). "c" indicates a pentagon, "d" indicates a hexagon, "e" indicates an octagon, "f" indicates an ellipse formed by a rectangle and both semicircular ends, and "g" indicates an oval.

According to the step-up transformer in accordance with the invention, a step-up transformer for magnetron driving comprises a magnetic circuit, including a middle core section, an outer core section and a coupling core section for coupling the middle core section and the outer core section, formed by an arrangement of two ferrite cores opposed to each other with a gap interposed therebetween, and a primary winding and a secondary winding arranged to surround the middle core respectively, wherein a sectional area of the middle core is increased; a number of winds in a radial direction of the primary winding to be wound around the middle core is increased and a number of winds in an axial direction is decreased; a number of winds in a radial direction of the secondary winding is increased and a number of winds in an axial direction is decreased; the primary winding and the secondary winding are provided close to each other interposing an insulator, and a sectional area of the outer core is set to be smaller than that of the middle core.

More specifically, the ratio of the sectional area of the middle core to that of the outer core is decreased to be 2:1 or less. Consequently, it is possible to reduce a size, thereby greatly decreasing an installation area on a printed board.

Moreover, the two ferrite cores are constituted by two U-shaped cores, or one U-shaped core and one I-shaped core. Consequently, the shape of the step-up transformer for magnetron driving can be simplified. In addition, a magnetic circuit having a high efficiency can be formed.

Furthermore, the shapes of the two U-shaped cores are identical to each other. Consequently, it is sufficient that only one kind of U-shaped core is manufactured. Thus, a production cost can be greatly reduced.

Each of the sectional shapes of the middle core section and the outer core section is an oval including a circle or a polygon. Consequently, the shape of the transformer can be simplified. In addition, a magnetic circuit having a high efficiency can be formed. In the case in which the middle core section is circular, particularly, the winding speed of the coil can further be increased.

Furthermore, $h2<D1$, $h2<h1$, $D2<D1$ or $D2<h1$ is set, in which a height in the case in which the middle core section takes a sectional shape of a polygon is represented by h1 or a diameter in a direction of a height in the case in which the sectional shape is an oval including a circle is represented by D1, and a height in the case in which the outer core section takes a sectional shape of a polygon is represented by h2 or a diameter in a direction of a height in the case in which the sectional shape is an oval including a circle is represented by D2. Consequently, a space is generated differently from the case of a conventional apparatus. Therefore, it is possible to dispose a high-voltage capacitor and a high-voltage diode to be high-voltage power circuit components.

What is claimed is:

1. A step-up transformer for magnetron driving, comprising:

a magnetic circuit, including a middle core section, an outer core section and a coupling core section for coupling the middle core section and the outer core section, formed by an arrangement of two ferrite cores opposed to each other with a gap interposed therebetween, and a primary winding and a secondary winding arranged to surround the middle core respectively, wherein a sectional area of the middle core is increased;

a number of winds in a radial direction of the primary winding to be wound around the middle core is increased and a number of winds in an axial direction is decreased;

a number of winds in a radial direction of the secondary winding is increased and a number of winds in an axial direction is decreased;

the primary winding and the secondary winding are provided close to each other interposing an insulator, and a sectional area of the outer core is set to be smaller than that of the middle core, wherein a height of a cross section of the outer core is smaller than a height of a cross section of the middle core.

2. A step-up transformer for magnetron driving according to claim 1, wherein sectional area of the outer core is set to be same as or smaller than a half of the sectional area of the middle core.

3. A step-up transformer for magnetron driving according to claim 1, wherein the two ferrite cores include two U-shaped cores, or one U-shaped core and one I-shaped core.

4. The step-up transformer for magnetron driving according to claim 3, wherein shapes of the two U-shaped cores are identical to each other.

5. The step-up transformer for magnetron driving according to claim 1, wherein each of sectional shapes of the middle core section and the outer core section is an oval including a circle or a polygon.

6. A step-up transformer for magnetron driving, comprising:

a magnetic circuit, including a middle core section, an outer core section and a coupling core section for coupling the middle core section and the outer core section, formed by an arrangement of two ferrite cores opposed to each other with a gap interposed therebetween, and a primary winding and a secondary winding arranged to surround the middle core respectively, wherein a sectional area of the middle core is increased;

a number of winds in a radial direction of the primary winding to be wound around the middle core is increased and a number of winds in an axial direction is decreased;

a number of winds in a radial direction of the secondary winding is increased and a number of winds in an axial direction is decreased;

the primary winding and the secondary winding are provided close to each other interposed by an insulator;

wherein each of sectional shapes of the middle core section and the outer core section is an oval including a circle or a polygon;

such that a sectional area of the outer core is set to be smaller than that of the middle core a height in the case in which the middle core section takes a sectional shape of a polygon is represented by h1, or a diameter in a direction of a height in the case in which the sectional shape is an oval including a circle is represented by D1, and a height in the case in which the outer core section takes a sectional shape of a polygon is represented by h2 or a diameter in a direction of a height in the case in which the sectional shape is an oval including a circle is represented by D2, the values of h1, D1, h2 and D2 are set in such a manner that the following formulae can be established:

$h2<D1$, $h2<h1$, $D2<D1$ or $D2<h1$.

* * * * *